US007096508B2

(12) United States Patent
Lesosky

(10) Patent No.: US 7,096,508 B2
(45) **Date of Patent: *Aug. 29, 2006**

(54) KNEEPAD

(76) Inventor: Thomas Jeffry Lesosky, 2655-133rd St., Surrey (CA) V4P 1X9

( * ) Notice: Subject to any disclaimer, the term of this patent is extended or adjusted under 35 U.S.C. 154(b) by 80 days.

This patent is subject to a terminal disclaimer.

(21) Appl. No.: 10/898,324

(22) Filed: Jul. 26, 2004

(65) Prior Publication Data

US 2004/0255356 A1 Dec. 23, 2004

Related U.S. Application Data

(63) Continuation of application No. 10/320,449, filed on Dec. 17, 2002, now Pat. No. 6,820,279.

(51) Int. Cl.
*A41D 13/00* (2006.01)

(52) U.S. Cl. ..... 2/24

(58) Field of Classification Search ..... 2/22, 2/24, 16, 455, 908, 911, 242; 128/881, 882; 602/6, 26, 62

See application file for complete search history.

(56) References Cited

U.S. PATENT DOCUMENTS

| | | | | | |
|---|---|---|---|---|---|
| 1,486,308 | A * | 3/1924 | Shook | 2/24 |
| 1,862,303 | A * | 6/1932 | Glahe | 2/24 |
| 4,287,885 | A * | 9/1981 | Applegate | 602/26 |
| 4,756,026 | A * | 7/1988 | Pierce, Jr. | 2/16 |
| 5,090,055 | A | 2/1992 | McElroy | |
| 5,446,926 | A * | 9/1995 | Bourque et al. | 2/22 |
| 5,477,559 | A * | 12/1995 | Clement | 2/22 |
| 5,937,440 | A * | 8/1999 | Ferriter | 2/24 |
| 6,029,273 | A * | 2/2000 | McCrane | 2/24 |
| 6,058,505 | A * | 5/2000 | Bettencourt | 2/24 |
| 6,223,350 | B1 * | 5/2001 | McFarlane | 2/24 |
| 6,253,376 | B1 | 7/2001 | Ritter | |
| 6,584,616 | B1 * | 7/2003 | Godshaw et al. | 2/24 |
| 6,820,279 | B1 * | 11/2004 | Lesosky | 2/24 |

FOREIGN PATENT DOCUMENTS

| | | |
|---|---|---|
| DE | 200 04 792 | 4/2001 |
| FR | 2648681 | 6/1989 |

* cited by examiner

*Primary Examiner*—Tejash Patel
(74) *Attorney, Agent, or Firm*—C. Larry Kyle; Nexus Law Group LLP

(57) ABSTRACT

A kneepad is formed of a shell and a detachable cushioning pad. The shell includes a knee area and a shin area. A non-flowable gel is provided in the cushioning pad. Preferably the gel is indented at the normal pressure point of contact of the patella. The outer surface of the shell is provided with a plurality of ribs surrounding a recessed portion to direct the pressure and shocks from the ground to the outer portions of the knee. The shell may also be provided with a resilient material between the ribs and the inner surface of the shell.

5 Claims, 6 Drawing Sheets

KNEEPAD

CROSS REFERENCE TO RELATED APPLICATIONS

This application is a Continuation of U.S. patent application Ser. No. 10/320,449 which was filed on Dec. 17, 2002, now U.S. Pat No. 6,820,279.

FIELD OF THE INVENTION

This invention relates to kneepads. In particular, this invention relates to strap-on kneepads such as may be worn by workmen, gardeners and the like.

BACKGROUND OF THE INVENTION

Kneepads are used to protect a user's knees when kneeling on a hard surface, or when extensive kneeling is required on any surface.

Typically, kneepads include a cover or shell designed to rest against the surface and a cushioning pad secured between the shell and the user's knee. Despite such arrangement, the knee, notably the patella, undergoes considerable stress from pressure or shock. While the cushioning pad provides a softer surface, the patella still ultimately bears the weight of the user against the shell, albeit through the compressed cushioning pad.

Kneepads are sometimes also uncomfortable to wear while moving about. The hard shell typically presents an impediment to full extension of the leg, thus requiring the user to remove the kneepad when intending to walk any reasonable distance. Removal of the kneepad may require the inconvenient disengaging of threaded loop fasteners and the like.

It is an object of the present invention to provide a kneepad which minimizes the stress on a user's patella and on the user's knee in general.

It is a further object of the invention to provide a kneepad that does not inhibit a user from walking comfortably.

These and other objects of the invention will be better understood by reference to the detailed description of the preferred embodiment which follows.

SUMMARY OF THE INVENTION

In one aspect, the invention comprises a kneepad having a shell and a detachable cushioning pad that is removably attached by, for example, snaps.

In another aspect, the invention comprises a knee pad having a shell and a cushioning pad, the cushioning pad including a gel for providing better cushioning and support for the knee.

In a more detailed aspect, the gel is a non-flowable gel. In yet a further aspect the gel is formed with a recess corresponding to the position of the patella when the knee pad is worn. In a more detailed aspect, the cushioning pad comprises a resilient material such as sponge formed into a generally trough-like shape, a gel on the inside of the trough and a covering over the resilient material and gel.

In another aspect, the invention comprises a kneepad having a shell and a cushioning pad, the shell including a resiliently deformable material, for example a spongy substance or a dense foam, in the area of the patella. In a further aspect the spongy substance extends shinward of the patella. In yet a further aspect, such spongy material is also provided in the area of a shinward extension provided in the shell.

It is a further aspect of the invention that the ground-engaging side of the shell is shaped to provide a recess opposite the location of the patella when the kneepad is worn, and a ground engaging structure surrounding the recess. As a result, the ground engaging portion structure forms a cup-like rim around a central recess. This distributes the pressure and shocks to the peripheral portions of the user's knee rather than focussing them at one point on the patella.

In yet another aspect of the invention, the ground-engaging side of the shell has a knee portion and a shinward extension. The shinward extension includes wing portions that come into contact with the surface of the object being kneeled upon while the central portion is recessed and does not engage the surface. In this fashion, the forces associated with kneeling are distributed to the outer edges of the user's shins.

According to another aspect of the invention, the ground-engaging side of the shell is formed of a series of ribs along the outer periphery, around a substantially oval recessed portion.

The shell is preferably made of a rubber-like substance that is resiliently deformable and semi-rigid.

In another aspect, the invention is a kneepad comprising a ground-engaging shell, said shell having a shape generally corresponding to a trough closed at one end, said shell having an inner posterior surface and an outer anterior surface, said outer anterior surface having a portion corresponding to the position of the patella of a user when the kneepad is worn, and wherein said portion comprises a central recessed portion and a peripheral ground-engaging structure at least partially surrounding said recessed portion. In a more particular aspect, the ground-engaging structure comprises a plurality of upstanding ribs.

In a further kneepad comprising a ground-engaging shell, said shell having a shape generally corresponding to a trough closed at one end, said shell having an inner posterior surface and an outer anterior surface, said outer anterior surface having a portion corresponding to the position of the upper shin of a of a user when the kneepad is worn, and wherein said portion comprises a central recessed portion and ground-engaging wings at each of two sides of said recessed portion.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE PREFERRED EMBODIMENT

A detailed description of the preferred embodiment will be provided by reference to the drawings thereof and of the prior art, in which.

Figure 1:
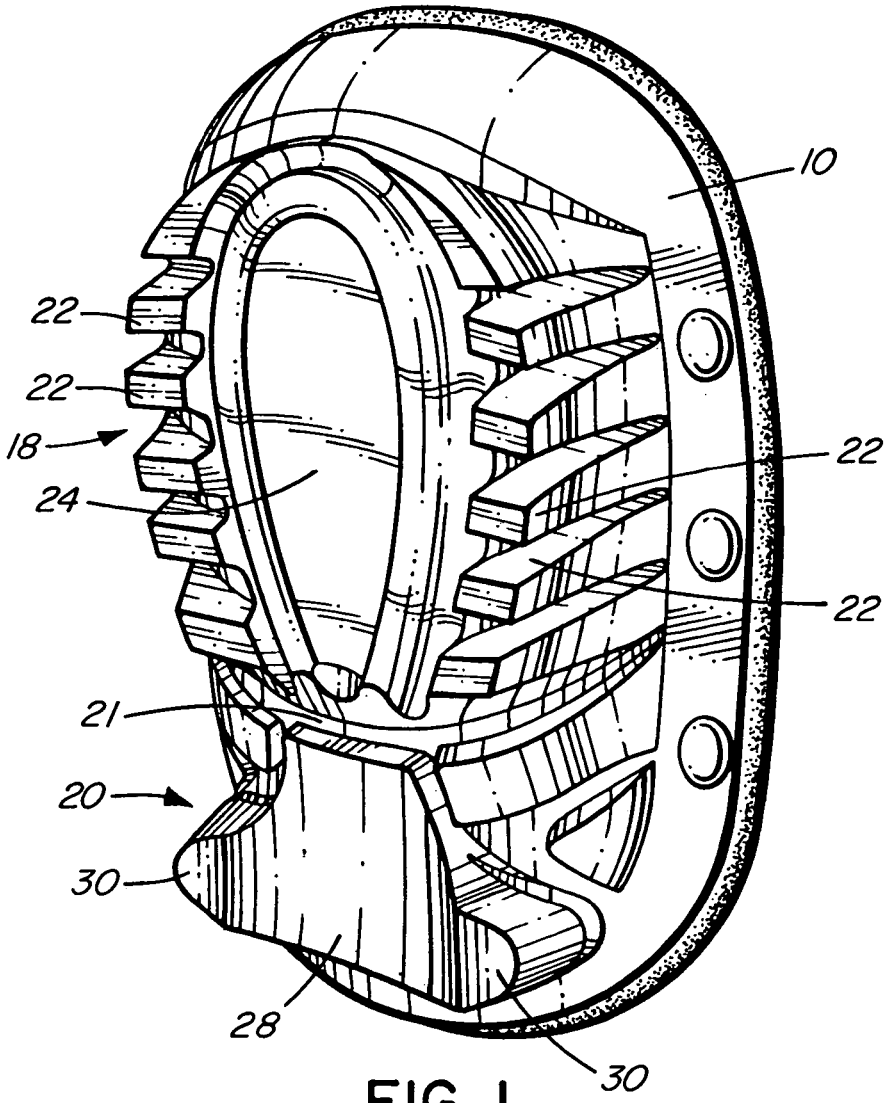
FIG. 1 is a perspective view of the kneepad of the preferred embodiment.

In the drawings, the strap that would normally be used to secure the kneepad on the knee is not shown.

DETAILED DESCRIPTION OF THE PREFERRED EMBODIMENT

Figure 7:
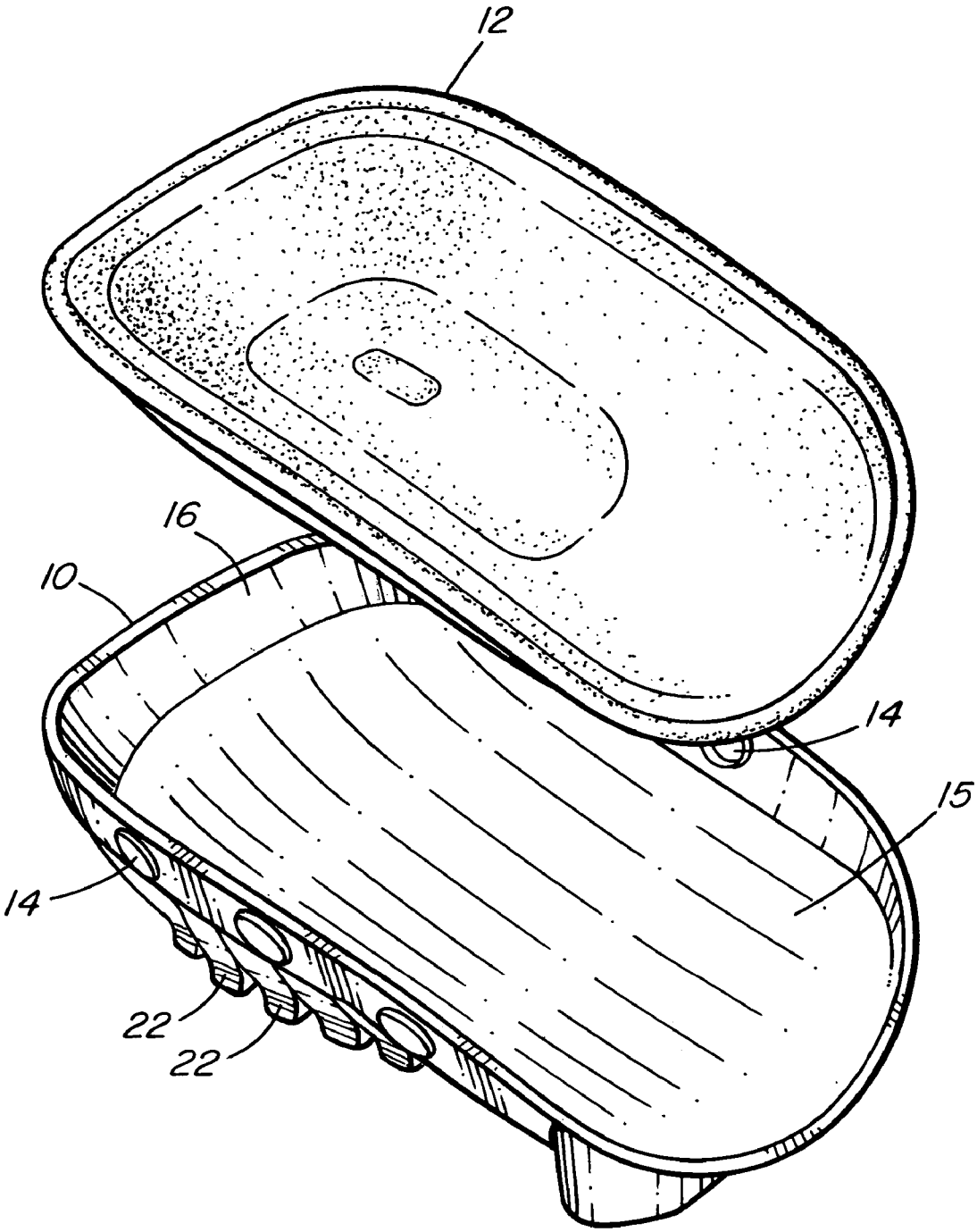
FIG. 7 is an exploded view of the shell and cushioning pad assembly according to the preferred embodiment.

As best appreciated by reference to FIG. 7, the preferred embodiment of the kneepad according to the invention includes a shell 10 and a cushioning pad 12. Shell 10 and cushioning pad 12 are releasably connectable by means of snaps 14 built into the outer portion of the cushioning pad 12 (not visible in the drawings) and the inner sides of the shell 10.

Figure 8:
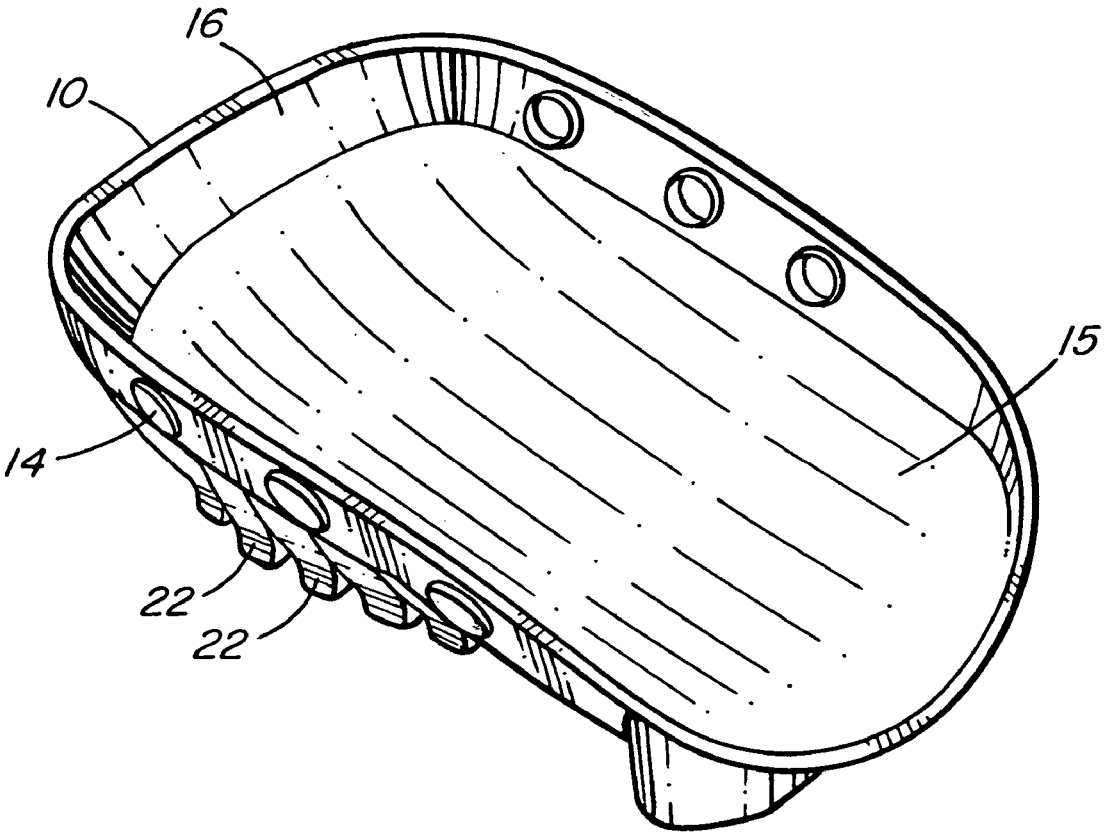
FIG. 8 is an inside perspective view of the shell.

Shell 10 has a generally trough-like inner surface 15 closed at one end 16 as best seen in FIG. 8. Cushioning pad 12 has an outer shape corresponding to the inner shape of the shell 10 into which it is designed to fit snugly.

Figure 2:
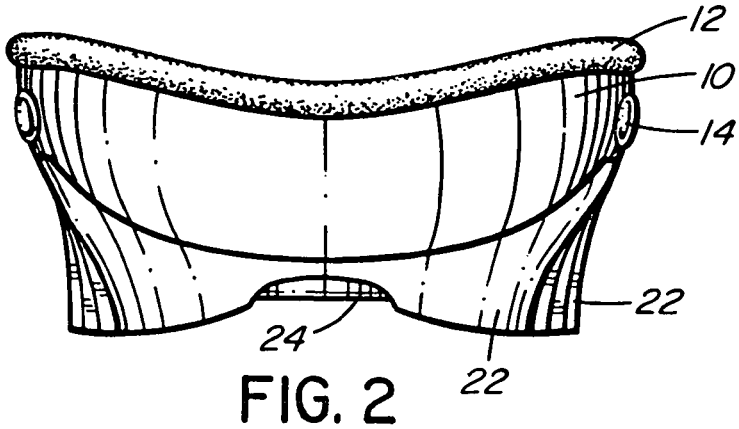
FIG. 2 is a top end view of the kneepad.
Figure 3:
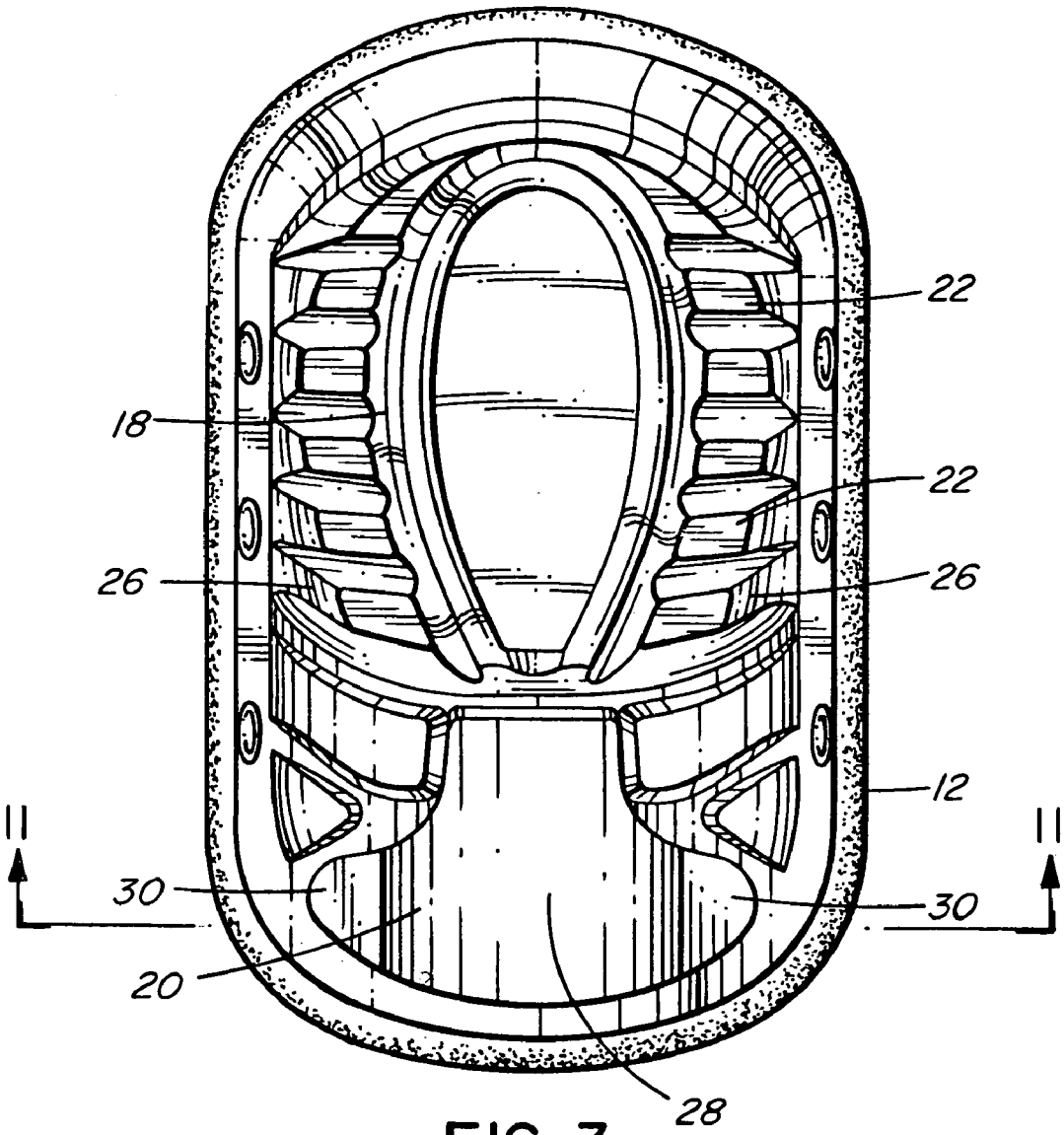
FIG. 3 is a front view of the kneepad.

Shell 10 has an outer surface formed in two sections, a knee section 18 and a shin section 20, with a gap 21 between the two sections, as best appreciated by reference to FIG. 1. Knee section 18 includes a series of upstanding ribs 22 partially surrounding a recessed portion 24. The recessed position of portion 24 in relation to ribs 22 is best appreciated by reference to FIG. 2. Ribs 22 are positioned so as to partially surround, in projection across the kneepad, the knee of the user when the kneepad is worn. The position of the recessed portion 24 corresponds, in projection across the kneepad, the position of the patella when the kneepad is worn. The lateral outer surfaces 26 of the ribs 22 are preferably angled and generally sloped or curved inward in the anterior direction as best appreciated by reference to FIG. 3. Preferably there is also a slight outward flare at the anterior most extent of the ribs. This arrangement allows the pressure and shocks from engagement of the kneepad with a surface to effectively be distributed around the outer portions of a user's knee rather than focussing them to a point of contact on the patella.

Figure 4:
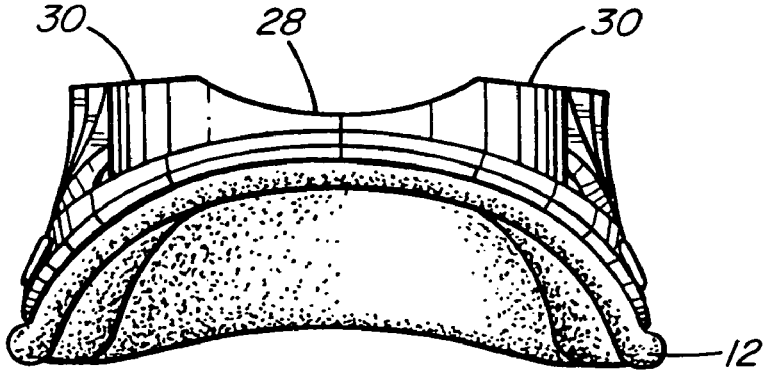
FIG. 4 is an inverted bottom end view of the kneepad.

The shin section 20 is also provided with a recessed portion 28 and opposed ground-engaging wings 30, best seen in FIGS. 1 and 4. This arrangement in the shin section 20 acts to distribute the pressure around the upper portion of the user's shin.

The shell 10 of the preferred embodiment is made of rubber or other resiliently deformable substance, thereby allowing partial deformation of the shell under the weight of the user. This enhances a hugging of the shell around the user's knee and serves to further distributes the pressure around the knee and the shin.

Figure 10:
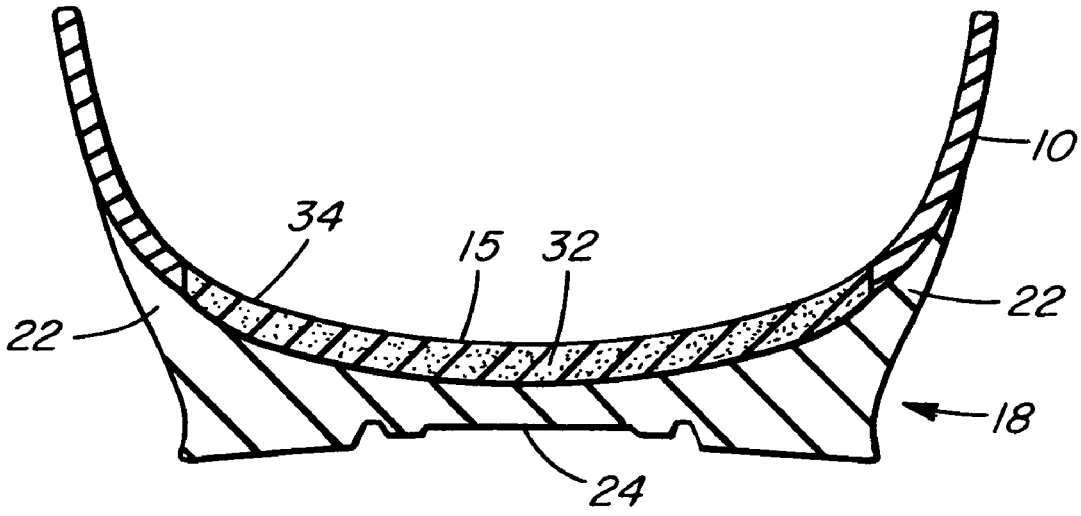
FIG. 10 is a cross-sectional view of the shell along line 10—10 of FIG. 6; and, FIG. 11 is a cross-sectional view of the shell along line 11—11 of FIG. 3.
Figure 11:
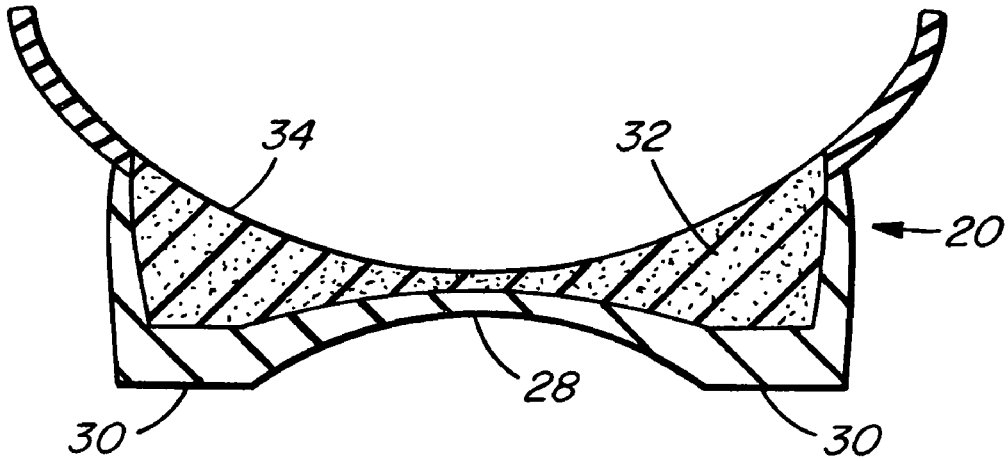

The ribbed structure of the outer portion of the shell 10 may tend to cause corresponding pressure points on the inside surface of the shell. Accordingly, the shell 10 incorporates a resiliently deformable material such as a dense foam 32 formed between the ribs 22, the recessed portion 24 and the inner surface 15, best illustrated in FIG. 10. Similarly such material 32 is also provided between the shin section 20 and the inner surface 15, as best illustrated in FIG. 11. A thin film 34 covers the foam 32 and the surrounding structure to complete inner surface 15. Apart from evenly distributing the pressure from the ribs 22, material 32 also enhances the cushioning effect of the kneepad.

Figure 5:
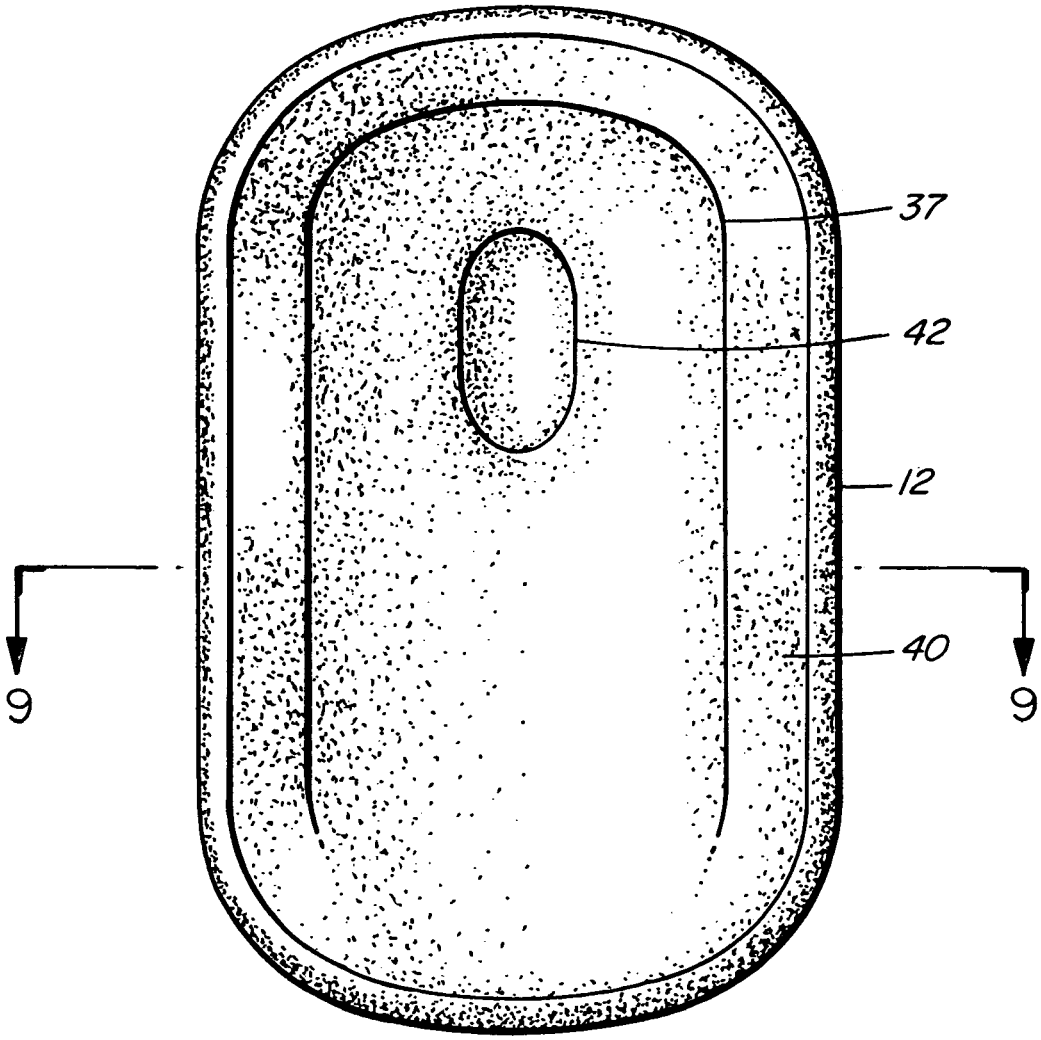
FIG. 5 is a rear view of the kneepad, with certain features exaggerated.
Figure 6:
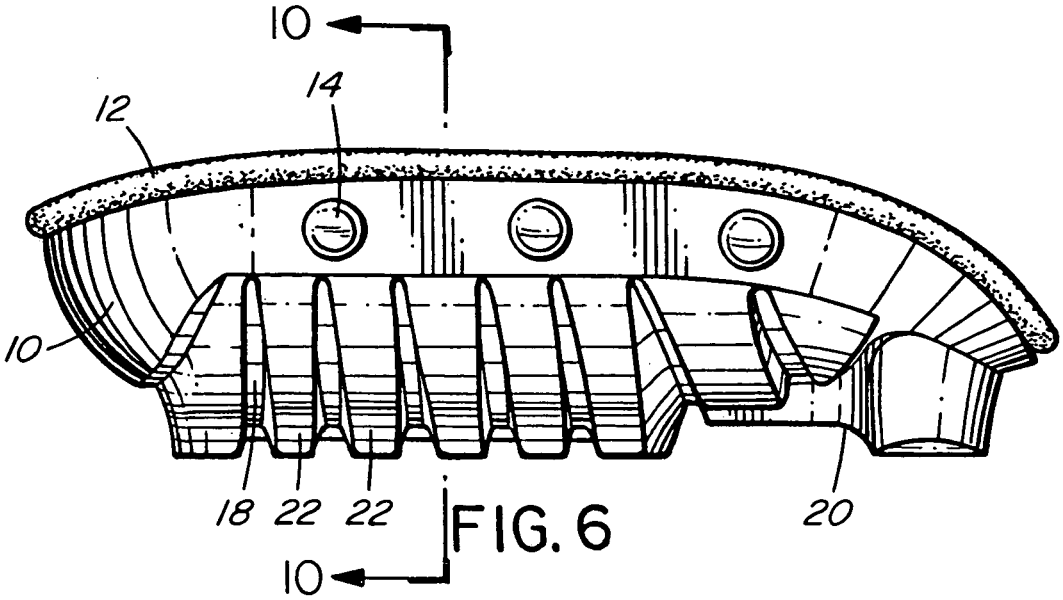
FIG. 6 is a side elevation of the kneepad.
Figure 9:
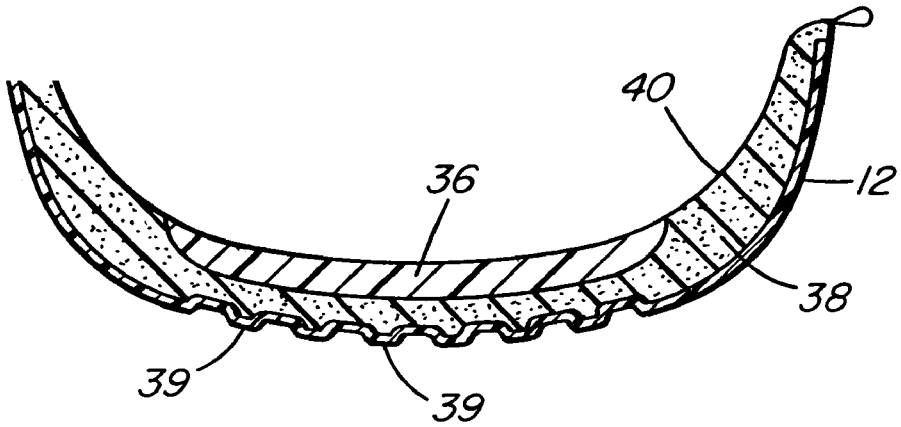
FIG. 9 is a cross-sectional view of the cushioning pad along line 9—9 of FIG. 5.

The provision of a gel 36 in cushioning pad 12 is best understood by reference to FIGS. 5 and 9. Cushioning pad 12 includes a non-flowable resilient gel 36 between a semi-rigid foam 38 and a covering 40. Gel 36 extends across the bottom of the inner surface of the cushioning pad 12 from the area of the patella to the area corresponding to the shin section 20 of the shell 10, as illustrated by the exaggerated definition lines 37 shown in FIG. 5 that are faintly visible in the actual product. Gel 36 is formed with an indentation 42 corresponding to the contact surface of the patella, as best seen in FIG. 5. It is noted that FIG. 5 exaggerates the effect of the underlying indentation 42 on the covering 40.

The outer surface of the cushioning pad, i.e. the surface that is in contact with the surface 15 of the shell 10, is preferably formed of a semi-rigid material having longitudinal shallow ribs 39 to provide shape stability to the pad.

The invention provides a very comfortable kneepad that distributes the stresses of kneeling to the periphery of the knee. It also provides additional support in the upper part of the user's shin and distributes the associated stresses to the outer portion of the shin.

In use, the shell may be temporarily detached from the cushioning pad to allow the user to walk about.

The preferred embodiment of the invention has been described in some detail. It will be appreciated that several inventive features have been described to reflect various aspects of the invention. It will also be appreciated that modifications may be practised on the preferred embodiment without departing from the principles of the invention.

The invention claimed is:

1. A kneepad comprising a unitary ground-engaging shell, said shell having a shape generally corresponding to a trough, said shell having an inner posterior surface and an outer anterior surface, said outer anterior surface having a portion corresponding to the position of the patella of a user when the kneepad is worn, said portion comprising a ground-engaging structure, said ground-engaging structure being adapted to divert pressure away from the patella of a user and towards the outsides of said user's knee.

2. The kneepad of claim 1 wherein said portion further comprises a recess.

3. The kneepad of claim 2 wherein said ground-engaging structure borders on at least a portion of the periphery of said recess.

4. A kneepad comprising:

a. shell;

a detachable cushioning pad comprising a resilient material permanently formed into a generally trough-like shape, a non-flowable gel retained in said resilient material and a covering over the resilient material and gel; and wherein said gel is formed wit a recess corresponding to the position of the patella when the knee pad is and wherein said cushioning pad is shaped to conform to an inner posterior surface of said shell.

5. A kneepad comprising a shell and a cushioning pad;

said shell having an outer surface and an inner surface and a shape generally corresponding to a trough;

said cushioning pad being positioned adjacent said inner surface;

said outer surface having a portion corresponding to the patella of a user, said portion comprising a central recessed portion and a ground-engaging structure, wherein said ground-engaging structure comprises a plurality of upstanding ribs.

* * * * *

UNITED STATES PATENT AND TRADEMARK OFFICE

CERTIFICATE OF CORRECTION

PATENT NO. : 7,096,508 B2
APPLICATION NO. : 10/898324
DATED : August 29, 2006
INVENTOR(S) : Thomas Jeffry Lesosky It is certified that error appears in the above-identified patent and that said Letters Patent is hereby corrected as shown below:

Column 4, line 47, “wit” should read --with--

Column 4, line 48, “when the knee pad is and” should read --when the knee pad is worn; and--

Signed and Sealed this

Twenty-sixth Day of December, 2006

JON W. DUDAS
*Director of the United States Patent and Trademark Office*